United States Patent [19]

Occhipinti

[11] Patent Number: 4,759,252

[45] Date of Patent: Jul. 26, 1988

[54] MUTE HOLDER

[75] Inventor: Peter Occhipinti, Itasca, Ill.

[73] Assignee: Lyons Music, Inc., Itasca, Ill.

[21] Appl. No.: 44,824

[22] Filed: May 1, 1987

[51] Int. Cl.[4] ..... G10D 7/10

[52] U.S. Cl. ..... 84/387 A; 84/400; 84/453; 248/229; 248/315

[58] Field of Search ..... 84/387 A, 400, 421, 84/453; 248/229, 314, 315, 443, 124

[56] References Cited

U.S. PATENT DOCUMENTS

| | | | |
|---|---|---|---|
| 1,777,823 | 10/1930 | Bernard | 84/400 |
| 1,975,303 | 10/1934 | Walker et al. | 248/315 X |
| 2,749,073 | 6/1956 | Guysi et al. | 248/315 X |
| 2,903,225 | 9/1959 | Weinstein | 248/315 X |
| 3,117,673 | 1/1964 | Hatfield et al. | 248/315 X |
| 4,084,778 | 4/1978 | Dominguez | 248/314 |
| 4,488,469 | 12/1984 | Demello et al. | 84/453 X |
| 4,611,722 | 9/1986 | Teig | 248/229 X |

*Primary Examiner*—L. T. Hix
*Assistant Examiner*—Brian W. Brown
*Attorney, Agent, or Firm*—Wall and Roehrig

[57] ABSTRACT

A mute holder for a musical instrument such as a trumpet, cornet, or trombone, as a clamp portion for attaching to a music stand, and a ring portion for holding the mute. The ring portion has a C-shaped fixed arcuate member and a pivoting sector that allows the mute to be taken out or replaced from the side. A spline-type joint between the clamp and the ring portion locks the angle of the mute holder at a selected one of a number of possible angles. A cam and lever clamp arrangement has several flat surfaces and adapts to fit music stands of any of a number of thicknesses.

9 Claims, 1 Drawing Sheet

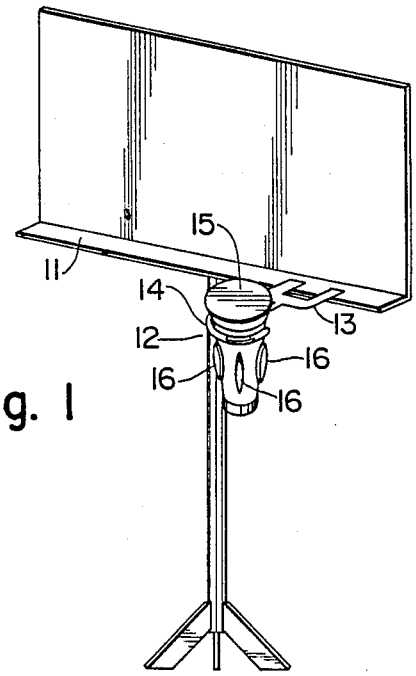
Fig. 1
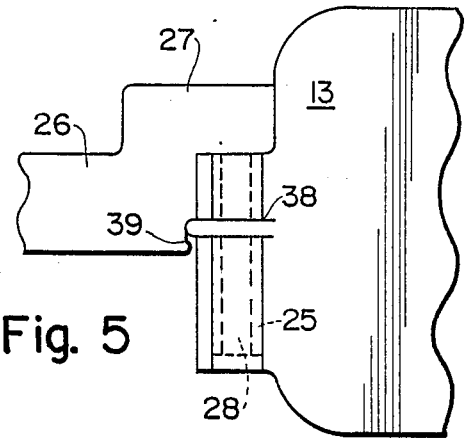
Fig. 5
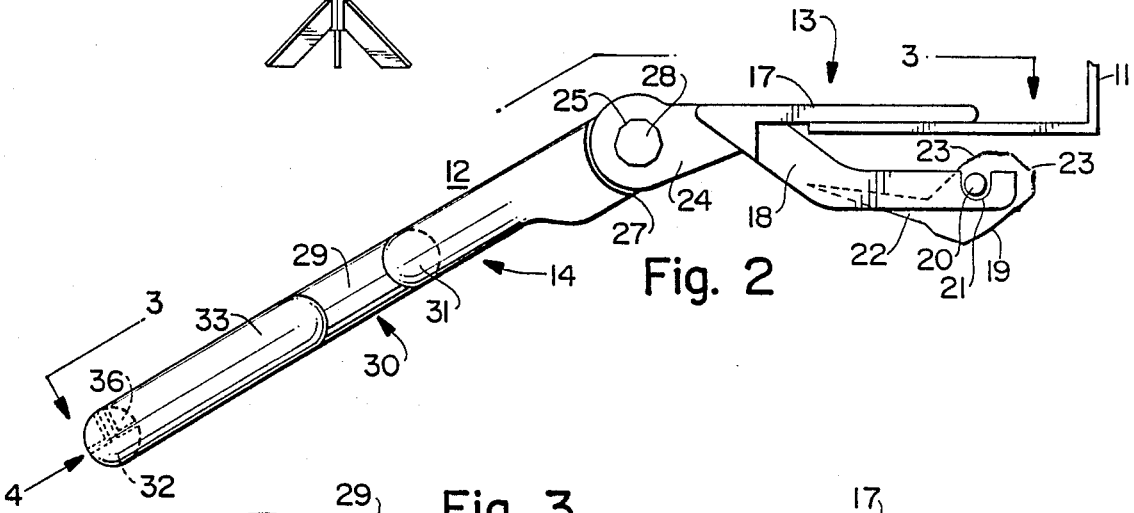
Fig. 2
Fig. 3
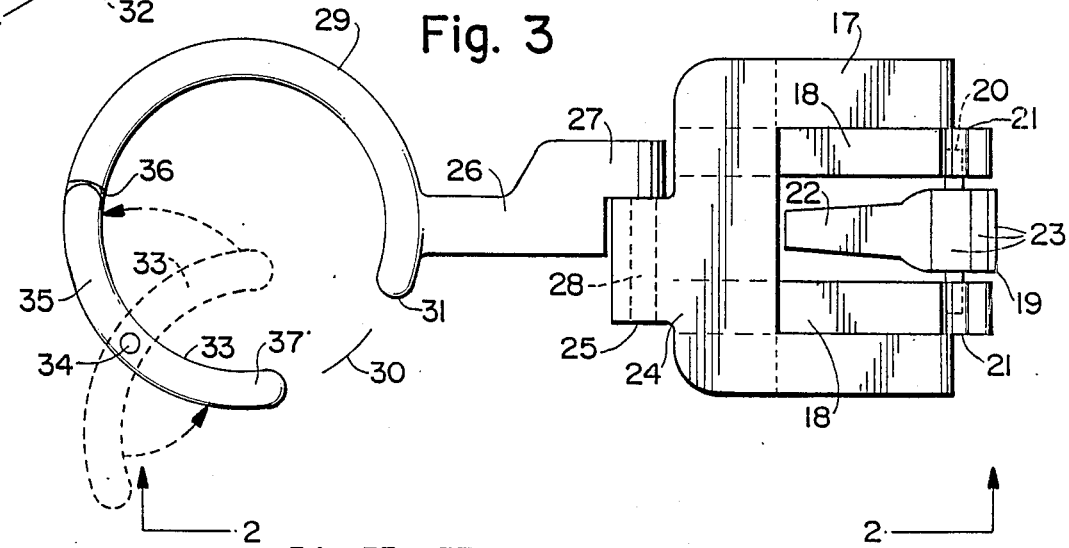
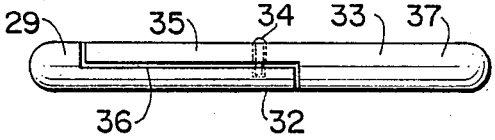
Fig. 4

MUTE HOLDER

BACKGROUND OF THE INVENTION

This invention relates to devices for holding the mute of a musical instrument, and is particularly directed to a mute holder that can be attached to a music stand and hold the mute in a manner that is convenient for the player of the instrument.

A conventional mute holder is typically comprised of a ring and a clamp member for clamping to a music stand or the like. A mute is typically cone shaped, with a number of corks at or near its narrow end to hold the mute in the bell of the cornet, trombone, or other instrument. The mute is inserted into the ring portion of conventional mute holders by its narrow end. The wide end of the conic mute rests against the ring, which encircles it. Then when the mute is needed, the mute is lifted entirely out through the ring. There is a tendency for the player to knock the corks against the ring. After a time, the corks can become loosened and come off the mute.

In addition, the conventional mute holder clamps do not adapt well to music stands of different thicknesses, nor can they be adjusted to hold the ring portion firmly at the desired angle that is most convenient for the player.

OBJECTS AND SUMMARY OF THE INVENTION

Accordingly, it is an object of this invention to provide a mute holder which avoids the drawbacks of the prior art.

It is a more specific object to provide a mute holder which is convenient to use and which avoids contact of the mute corks with the holder.

It is another object of this invention to provide a mute holder which can be employed with music stands with ledges of a variety of thicknesses.

It is still another object of this invention to provide a mute holder which can be locked at any of a number of predetermined angles, as selected to be most convenient for the player.

According to an embodiment of this invention, the mute holder comprises a support, and an open arcuate member attached in a fixed relation to the support with a pair of ends that define a gap to one side of the arcuate member. A moveable arcuate segment is swingably mounted on a pivot at one end of the fixed arcuate member, and this arcuate segment has one portion that extends from the pivot into the gap and another portion that extends from the pivot back along the fixed arcuate member. The arcuate segment swings open to accept the mute, when inserted from the side through the open gap, and swings closed when the mute is inserted, to hold the mute securely in place until it is needed by the player. When the player needs the mute, he simply lifts it slightly, and moves it towards the gap. This swings open the movable arcuate segment, and permits the mute to be removed from the side.

In a preferred embodiment, the support includes clamp means that can be attached to a flat horizontal web, such as the ledge of a music stand, and locking means for locking the fixed arcuate member at any of a number of predetermined angles relative to the clamp means. This locking means favorably includes a pin that extends horizontally with and has spline structure formed on it. This structure for example, can be a prismatic cross section in the form of a regular polygon. The clamp can have a mating horizontal socket that coacts with the spline structure of the pin to lock at the desired one of these angles. In order to accommodate music stands of any of a variety of thicknesses, the clamp means has a first member contacting one side of the latch of the music stands, and a second member disposed at the other side of the latch. A cam is rotatably held on the second member to contact the other side of the flat horizontal web. Favorably, the cam has a plurality of flat cam faces, each at a different distance from the cam pivot axis.

The above and many other objects, features, and advantages of this invention will be more fully understood from the ensuing detailed description of a preferred embodiment, which should be read in connection with the accompanying drawing.

BRIEF DESCRIPTION OF THE DRAWING

FIG. 1 is a perspective view showing a music stand, with a mute holder according to one embodiment of this invention, and with a mute for a cornet, trombone, or similar musical instrument.

FIGS. 2, 3, and 4 are a side elevation, a top plan view, and an end elevation, respectively, of the mute holder of this embodiment. FIG. 5 illustrates details of optional locking structure according to an embodiment of this invention.

DETAILED DESCRIPTION OF A PREFERRED EMBODIMENT

With reference to FIG. 1, a music stand 10 has a more-or-less horizontal flat ledge 11 or web onto which a mute holder 12 of this invention is attached. The mute holder 12 basically comprises a clamp portion 13 which clamps to the music stand ledge 11, and a ring portion 14 which holds a cornet mute, trumpet mute, or trombone mute 15. As illustrated, these mutes are of generally conic shape, and have three corks 16 disposed near the narrow end thereof.

Details of the mute holder 12 of this invention are shown in detail in FIGS. 2, 3, and 4.

The clamp portion 13 of the mute holder 12 comprises an upper plate 17 and a pair of arms 18 which extend below the ledge 11 and parallel to the plate 17. A clamping cam 19 has a horizontal pivot 20 which fits into mounting recesses 21 in the arms 18. A lever 22 extends from the cam 19 to rotate the latter. The cam 19 has a number of flat cam faces 23, each disposed a different distance away from the axis or pivot 20. This clamp portion 13 is affixed onto the ledge 11 by fitting the ledge 11 into the space between the top plate 17 and the arms 18, and then rotating the lever 22 until the lower surface of the ledge 11 is firmly biased against one of the flat faces 23.

A protuberance 24 formed on the proximal side of the clamp member 13 has a horizontal bore or socket 25 which is prismatic and in cross-section is in the form of a regular ten-sided polygon.

The ring portion 14 has a stem 26 with an offset 27 at the distal side thereof. A horizontal pin 28 extends from the offset 27 and fits into the socket 25. This pin 28 is also in the form of a ten-sided prism. The prismatic cross sectional shape of the pin 28 and socket 25 serve as spline structure and hold the ring portion 14 at any one of ten predetermined angles relative to the clamp portion 13, and thus, also relative to the music stand 11.

On the ring portion 14 there is an open, generally C-shaped arcuate member 29 which is unitarily formed with the stem 26. This arcuate member 29 has a gap 30 at one side, defined by a first end 31 which is affixed at a proximal end of the stem 26, and a second end 32. The stem extends radially from the first end 31. The arcuate member 29 subtends an angle of between about 180 degrees and 270 degrees, preferably in the vicinity of 225 degrees. A smaller arcuate member 33, of the same radius, is swingably mounted at its midpoint on a pivot pin 34, with the pivot pin 34 being disposed at the end 32 of the fixed arcuate member 29. The member 33 subtends an arc angle of between about 90 and 150 degrees, favorably in the vicinity of about 135 degrees.

The arcuate member 33 is free to swing, except when restrained by the presence of the mute 12. The arcuate member 33 swings between a closed position shown in solid lines in FIG. 3, and an open position shown in ghost lines in FIG. 3. As shown in FIG. 4, the arcuate member 33 has an inner portion 35, i.e., to the left in FIG. 4, that extends from the pivot pin 34 back along the curve of the fixed arcuate member 29. This inner portion 35 is half-round in cross section, and fits into a cutout 36 formed in the proximal part of the arcuate member 29 near its end 32. An outer portion 37 of the member 33, which extends into the gap 30 from the pivot pin 34, is of round cross section.

The mute holder 12 of this invention is employed generally as follows:

The mute 15 is inserted into the gap 30, i.e., against the inner portion 35 of the member 33. The narrow end of the mute 15, with the corks 16, is positioned below the ring portion of the holder 12. The movement of the mute 15 pivots the arcuate member 33 into the position illustrated by solid lines in FIG. 3. The mute 15 rests in contact with the entire ring portion 14, with the arcuate member 33 held against movement by the mute 15. This, in turn, holds the mute 15 securely in place. To remove the mute 15 from the holder 12, the reverse operation is employed. The player lifts the mute 15 slightly upward and then brings the mute 15 outward through the gap 30. This swings the arcuate member 33 to the open position, as shown in ghost lines in FIG. 3. The mute 15 is removed from the holder 12 without lifting the narrow end through the ring portion, and thus without risking contact of the corks 16 with the holder 12.

The arrangement illustrated in FIG. 5 is basically the same as that of FIG. 3, except that the clamp portion 13 has an annular retaining rib 38 formed on the protuberance 24. This fits into a recess 39 at the distal end of the stem 26. The rib 38 and recess 39 lock together to retain the pin 28 in the socket 25. The inherent flexibility of the plastic materials which are preferably employed in this mute holder 12 permit the player to overcome holding the force of the rib 38 and recess 39, and to pull apart the ring portion 14 from the clamp portion 13 so that a new angle can be selected if desired.

While the mute holder of this invention has been described in detail with respect to a preferred embodiment, it should be recognized that the invention is not limited to that precise embodiment, and that many modifications and variations thereof would be apparent to those of skill in the art without departing from the scope and spirit of this invention, as defined in the appended claims.

What is claimed is:

1. A holder for the mute of a musical instrument comprising:

a support an open arcuate member attached in fixed relation to said support and having a pair of ends defining a gap therebetween; and a moveable arcuate segment swingably mounted on a pivot at one end of the fixed arcuate member, the arcuate segment having one portion that extends from said pivot into said gap and another portion that extends from said pivot along said fixed arcuate member.

2. The mute holder of claim 1 wherein said support includes clamp means for attaching to a flat web and means for locking said fixed arcuate member at any of plural predetermined angles relative to said clamp means.

3. The mute holder of claim 2 wherein said locking means includes a stem extending from said arcuate member and having a pin extending horizontally therefrom with spline structure formed thereon; and said clamp means has a mating horizontal socket coacting with the spline structure of said pin for locking the stem at any of said predetermined angles.

4. The mute holder of claim 3 wherein said pin with said spline structure is a prism having as its cross section a regular polygon, and said socket is a mating prismatic bore.

5. The mute holder of claim 3 wherein said locking means includes a rib on one of said stem and said clamp means which mates with a recess on the other of said stem and said clamp means to retain said horizontal pin in said socket.

6. The mute holder of claim 2 wherein said clamp means includes a first member contacting one side of said flat web and a second member disposed at the other side of said flat web; and a cam rotatably held on said second member to contact said other side of the flat web; said cam including means to engage and bias against said other side of the flat web at any of plural distances from said first member.

7. The mute holder of claim 6 wherein said cam has a pivot axis, a plurality of flat cam faces each at a different distance from said pivot axis, and means for manually rotating said cam.

8. The mute holder of claim 1 wherein said fixed arcuate member is C-shaped and subtends an angle of between about 180 degrees and 270 degrees, and said arcuate segment subtends an angle of between about 90 degrees and 150 degrees.

9. The mute holder of claim 1 wherein said pivotal arcuate segment is pivoted substantially at a midpoint thereof.

* * * * *